US005755164A

United States Patent [19]

Korte et al.

[11] Patent Number: 5,755,164

[45] Date of Patent: May 26, 1998

[54] ADJUSTABLE TABLE SYSTEM

[75] Inventors: Friedrich Korte; Reinhard W. Weber, both of Minden, Germany

[73] Assignee: VS Vereinigte Spezialmobelfabriken GmbH & Co., Tauberbischofsheim, Germany

[21] Appl. No.: 763,193

[22] Filed: Dec. 10, 1996

[30] Foreign Application Priority Data

Dec. 18, 1995 [DE] Germany ..... 195 47 052.4

[51] Int. Cl.[6] ..... A47B 3/06

[52] U.S. Cl. ..... 108/157.18; 108/158.13

[58] Field of Search ..... 108/157, 154, 108/158, 159, 90, 157.1, 157.13, 157.15, 157.18, 158.13; 248/188, 188.1, 188.7, 188.8

[56] References Cited

U.S. PATENT DOCUMENTS

| | | | |
|---|---|---|---|
| 1,800,685 | 4/1931 | Griffis | 108/157 |
| 3,048,459 | 8/1962 | Moore . | |
| 4,836,481 | 6/1989 | Ceccarelli | 248/188.1 |
| 4,944,235 | 7/1990 | Jahnke et al. | 108/157 |
| 5,035,186 | 7/1991 | Uredat et al. | 108/159 |
| 5,165,638 | 11/1992 | Fallon et al. | 248/188 X |
| 5,205,223 | 4/1993 | Ball et al. | 108/157 X |
| 5,289,784 | 3/1994 | Waibel | 108/157 |
| 5,333,423 | 8/1994 | Propst | 248/188 X |

FOREIGN PATENT DOCUMENTS

| | | | |
|---|---|---|---|
| GM 1994083 | 9/1968 | Germany . | |
| 3816269 | 11/1989 | Germany | 248/188.1 |
| 3835714A1 | 4/1990 | Germany . | |
| 9416016U1 | 2/1995 | Germany . | |
| 29510507U1 | 11/1995 | Germany . | |
| 4230436C2 | 11/1995 | Germany . | |
| 477 186 | 10/1969 | Switzerland . | |
| 2228859 | 9/1990 | United Kingdom | 108/154 |

OTHER PUBLICATIONS

German Search Report in DE 195 47 052.4 dated 13 Sep. 1996.

*Primary Examiner*—Jose V. Chen
*Attorney, Agent, or Firm*—Quarles & Brady

[57] ABSTRACT

An adjustable table system, particularly for conference or office tables, has at least one table leg with a table leg strut that can be attached from below the table top in one of several predetermined positions by sliding a first member with two spaced apart rows of longitudinally spaced engagement noses into engagement with a second member fixed to the underside of the table which also has two laterally spaced apart rows of longitudinally spaced engagement noses, wherein the noses of the first and second members are slidingly mated and secured in a mating position by a rotary locking mechanism. The table leg also has telescoping inner and outer tubes with a plastic bushing interposed therebetween and a setscrew mechanism at the top, with the leg being adjustable in the longitudinal direction by direct operation of the set screw from the top of said table leg or by rotating the outer tube in relation to the inner tube.

15 Claims, 6 Drawing Sheets

ADJUSTABLE TABLE SYSTEM

FIELD OF THE INVENTION

The present invention relates to an adjustable table system, particularly for conference or office tables, for receiving at least one table top or leaf, having a table leg and at least one table leg strut, stay or brace, which is adjustable relative to the table top.

BACKGROUND OF THE INVENTION

Adjustable table systems are used in offices, conference and meeting rooms, where the tables are differently arranged and reorganized, individually set up or assembled. In order to avoid an accumulation of table legs on assembling together several tables and achieve a strong mutual connection between the individual tables, it has already been proposed to connect to a table leg several table leg struts and as a result support several working boards or plates.

A fundamental problem with such table systems is the stability and rigidity, because as a result of unfavorable leverage conditions often small forces acting on the table top are sufficient to relatively strongly deflect it and cause rocking and oscillating movements thereto.

An adjustable table system of the aforementioned type is known from DE-42 30 436 C2, in which a variable number of table leg struts can be connected to a corresponding table leg and are in each case connected to a frame carrying a corresponding table top. The table leg strut is insertable in a guide on the sides of the top parallel to the plane of the latter and can be fixed there.

With this table leg strut arrangement, for the connection of a table leg to several table leg struts of different table tops, the corresponding struts must be previously inserted in the associated guides, because the sliding directions of different table leg struts intersect and the struts, if fixed to a common table leg, are no longer movable relative to the assembled table tops. This spatially confines and renders relatively complicated the installation of several struts on a table leg and the conversion of the table system.

SUMMARY OF THE INVENTION

Therefore, it is an object of the present invention to provide a further developed, adjustable table system, which has a high stability and rigidity and which easily and rapidly permits reorganization and conversion.

To achieve this the present invention provides a table system wherein the table leg strut is attachable to the table top from an underside thereof in several predetermined positions and a rapid locking device is provided for locking the table leg strut in said predetermined positions.

For conversion purposes the table leg strut can be removed from the table top, mounted on a table leg, on which optionally several table top struts can be mounted and can then be connected to the table leg preferably perpendicularly thereto from below and directly attached thereto and locked in this position with the table leg strut being connected to the table leg. This obviates the need for a burdensome extraction, sliding and insertion of the table leg struts and a table leg can be very easily and rapidly fixed to several table tops preassembled with several table leg struts.

In order to achieve a high stability and receive the table top in rocking-free and rigid manner, the rapid locking device can advantageously have a clamping mechanism for clamping the table leg strut. Preferably the force transfer is distributed over several clamping points spaced in a plane and the table leg strut is clamped towards the table top. The spaced clamping points create favorable leverage conditions and permit high clamping forces, so that the table top is received in a very rigid manner.

Preferably the rapid locking device has two locking parts, whereof one is rigidly connected to the table top, e.g. by screwing, bonding or in the case of metal table tops by welding, whilst the other locking part is rigidly connected to the table leg strut and is in particular integral and in one piece therewith. The two locking parts are advantageously lockable together in raster-like manner in different positions and can preferably be superimposed along a straight line, the two locking parts being braced against one another in the locked state. Preferably the two locking parts have in each case regularly spaced recesses and complementary projections for engagement with one another, the recesses and projections matching one another in different positions of the locking parts. The table leg can be adjusted from a position within the contour of the table top, i.e. below the latter, to a position in which the table leg projects laterally over the table top, so as to e.g. receive and support several table leg struts for several juxtaposed working boards.

In order to achieve a particularly high rigidity of the bracing system, the rapid locking device can have a displaceable engagement part with several engagement noses arranged in comb-like manner and which can be brought into locking engagement with a complementary engagement part. The movable engagement part is preferably displaceable in translatory manner in a plane parallel to the table top and is movable between a locking position and a position in which the locking engagement is released. Thus, the rapid locking device can have a shift interlock with several engagement noses, which in the case of a sliding parallel to the table top braces the table leg strut perpendicular to said top and presses flat thereon. Through the use of such a shift interlock as a result of a uniaxial movement of a component very simply and rapidly relatively high clamping forces can be obtained at spaced clamping points, so that the locking is very rigid and stable.

In order to bring the displaceable engagement part into its locking position and its release position, a preferably crank-like sliding mechanism can be provided, which by means of an operating element such as e.g. a hand lever allows the locking of the engagement part with limited force. Preferably a rotary setting or control part is provided, which engages with a guide, particularly a guide groove formed in the displaceable engagement part, so that the latter is displaced when the control part is rotated. Such a gear mechanism, which is preferably self-locking in order to avoid unintentional release, makes it possible to operate in an accurate manner the locking mechanism with limited forces.

It is also conceivable to move the movable engagement part in rotary manner and to screw it or engage it in bayonet-like manner with the complementary engagement part associated with the table top in order to brace against the latter the table leg strut. However, the aforementioned embodiment has advantages with respect to the leverage conditions of the bracing action and the rigidity of the connection between the strut and the top.

The displaceable engagement part and the associated sliding mechanism are advantageously associated with the table leg strut.

According to a preferred embodiment of the invention the table leg strut is constructed as a hollow section, e.g. in the form of a sheet steel structure, in order to obtain high rigidity accompanied by low weight. Preferably the part of the rapid locking device associated with the table leg strut is located within the hollow section, which leads to the advantage that on operating the locking system no injury risk exists, because the clamping mechanism is located in the interior, whilst at the same time any dirtying of the clamping mechanism is avoided.

In conventional table systems there was also the disadvantage that the height of the working surface, i.e. the table top could not always be adjusted in the desired way and it was only possible to compensate in an unsatisfactory manner unevennesses and steps on the standing surface, i.e. the floor. It is therefore another object of the invention that the level of the working surface can be rapidly and easily adjusted and for the table legs to be adapted in uncomplicated manner to the circumstances of the standing surface.

According to the invention, the table leg of the table system has at least two telescopable tubes, an adjustment mechanism being provided for adjusting the two tubes and being arranged within the table leg, and the table leg is longitudinally adjustable by direct actuation of the adjustment mechanism from the top of the leg and/or by turning the two tubes relative to one another.

The height of the table leg strut can consequently be modified by a corresponding table leg adjustment. It is particularly advantageous that the adjusting mechanism can be directly operated from the top of the table leg, because there is no need for the operator to bend in order to adjust at the lower end of the table leg possibly outwardly turnable feet or to fit extensions. The direct operation from the top of the adjusting mechanism is particularly advantageous in the case that the table leg is fitted in a position projecting over the table top, if several table tops are interconnected in network-like manner and are jointly supported by a table leg. The table leg can be adjusted by turning the two tubes relative to one another, so that a longitudinal adjustment of the leg is still possible if it is not feasible to operate the adjusting mechanism from the top, i.e. if the table leg is positioned below the table top. In addition, the adjustment possibility by turning the two tubes allows a rough setting of the length of the table leg in the disassembled state, i.e. prior to mounting the leg on the table top.

Preferably the adjusting mechanism has a screw connection between the two tubes, one setscrew axially parallel to the tubes being rotatable relative to one of the tubes e.g. by means of a bush inserted in or placed on the tube and is axially firmly mounted and can be in screw engagement with the second tube, e.g. once again by means of a bushing. The table leg can also have more than two tubes, but the construction with two tubes offers an adequate adjustability in the case of low weight and high rigidity.

In order when adjusting the table leg length to prevent a scratching and also so as to avoid the rocking of the tubes, preferably between the two tubes is provided as a guide a guide bushing, which is preferably made from plastic, which slides on at least one of the two tubes and guides both tubes relative to one another in their axial position.

According to a preferred embodiment of the invention at its upper end the table leg has a head, which is connectable to at least one table leg strut, the adjusting mechanism being connected to the head for the longitudinal adjustment of the leg and is preferably located in the interior thereof. The axially parallel setscrew of the adjusting mechanism can be directly received in rotary and axially firm manner in the head.

The head advantageously has a clamping device for clamping at least one table leg strut and preferably the clamping device has two mutually adjustable and in particular screwable clamping parts between which can be fixed the strut. Preferably the head is rotationally symmetrical, so that several table leg struts can be fixed in random angular positions.

According to an advantageous embodiment of the invention, the longitudinal adjusting mechanism and the clamping device are operable along coaxial axes. Both the setscrew of the adjusting mechanism and the clamping parts which can be screwed together can be screwed along the longitudinal axis of the table leg. The table leg consequently has a head, which firstly permits a fixing of one or more table leg struts and secondly allows a longitudinal adjustment of the table leg.

In order to variably adapt the table system to different requirements, on the table leg can be mounted an extension for receiving a further table top in a further plane, the extension preferably being a further table leg with struts fixable thereto. Preferably the extension can be mounted directly on the table leg head, if the leg is positioned so as to project over the table top. The extension could also be mounted on the table leg by means of a connecting piece, which could be fixed in the head, but the previously described embodiment is easier to construct and can be rapidly reassembled.

In order to attain an adequate rigidity, the table leg strut and in particular the table leg head are preferably made from steel.

These and further features can be gathered from the claims, description and drawings and the individual features, both singly and in the form of subcombinations, can be implemented in an embodiment of the invention and in other fields and represent advantageous, independently protectable constructions for which protection is hereby claimed.

The invention is described in greater detail hereinafter relative to embodiments. Such embodiments do not necessarily represent the full scope of the invention, however, and reference must be made therefore to the claims for interpreting the scope of the invention.

DETAILED DESCRIPTION OF THE PREFERRED EMBODIMENTS

Figure 1:
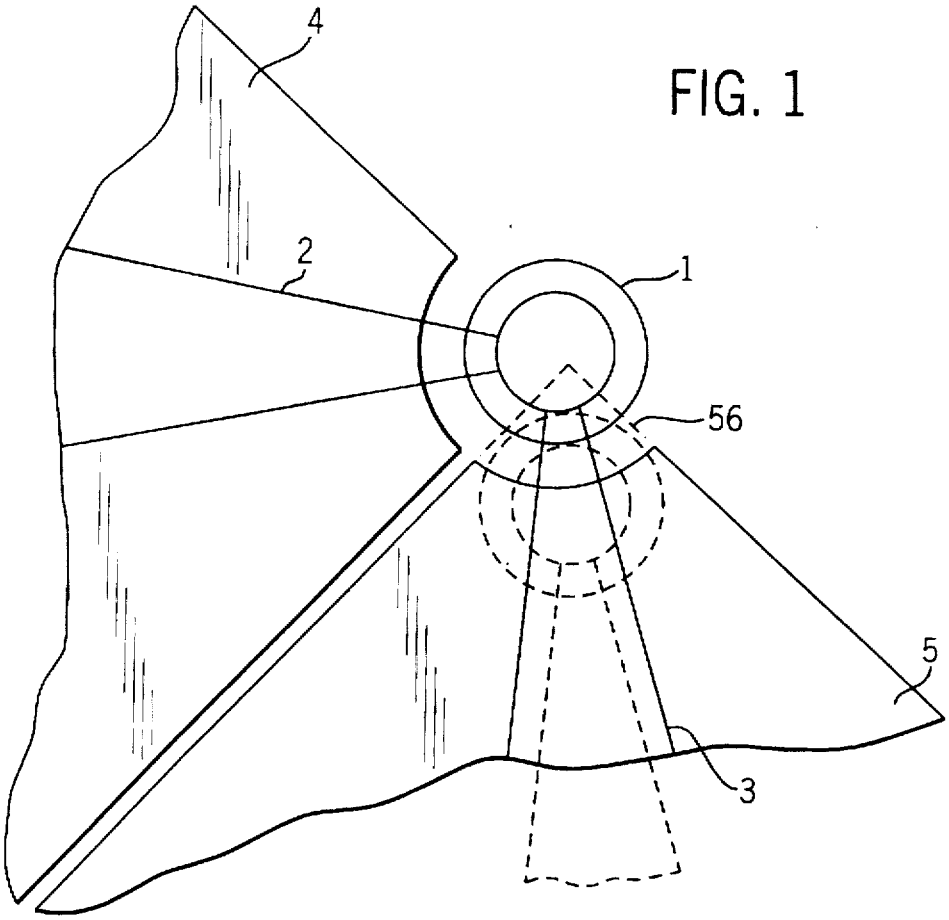
FIG. 1 is a plan view of an adjustable table system according to a preferred embodiment of the invention with a table leg and two table leg struts fixed thereto and with which it is possible to support two juxtaposed table tops.

FIG. 1 shows an adjustable table system with a table leg 1, to which are fixed in the represented case two table leg struts, stays or braces 2 and 3, which carry two table tops, boards or leaves 4 and 5. As will be explained hereinafter, the table system can be converted, in such a way that a table leg can be associated with an individual table top. In this case the table leg, as shown in broken form in FIG. 1, is positioned below the table top and fixed with a table leg strut 3 to the particular table top 5. If several tables are assembled, it would be possible to fix several table leg struts to a table leg, so as to support jointly several table tops with one table leg. In this case the table leg is preferably located in a central position projecting over the particular table top, as shown in FIG. 1.

As shown in FIG. 1, the corners of the table tops 4 and 5 are recessed in the vicinity of the table leg 1, so as to allow access to the leg head and, as will be explained hereinafter, so as to mount an extension on the table leg. However, the said recesses on the table top can be covered with a cap 56. Without this being expressly shown, it would also be possible to support the two table tops 4 and 5 with a table leg 1 in a position below the two tops.

Figure 3:
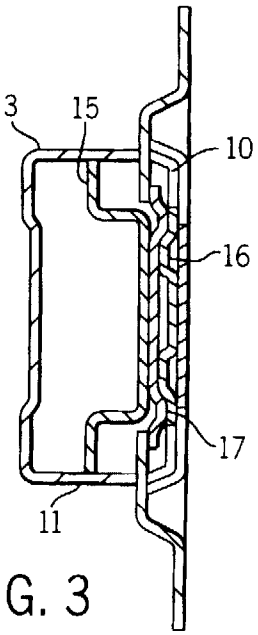
FIG. 3 is a sectional front view of the table leg strut and locking device of FIG. 2.
Figure 2:
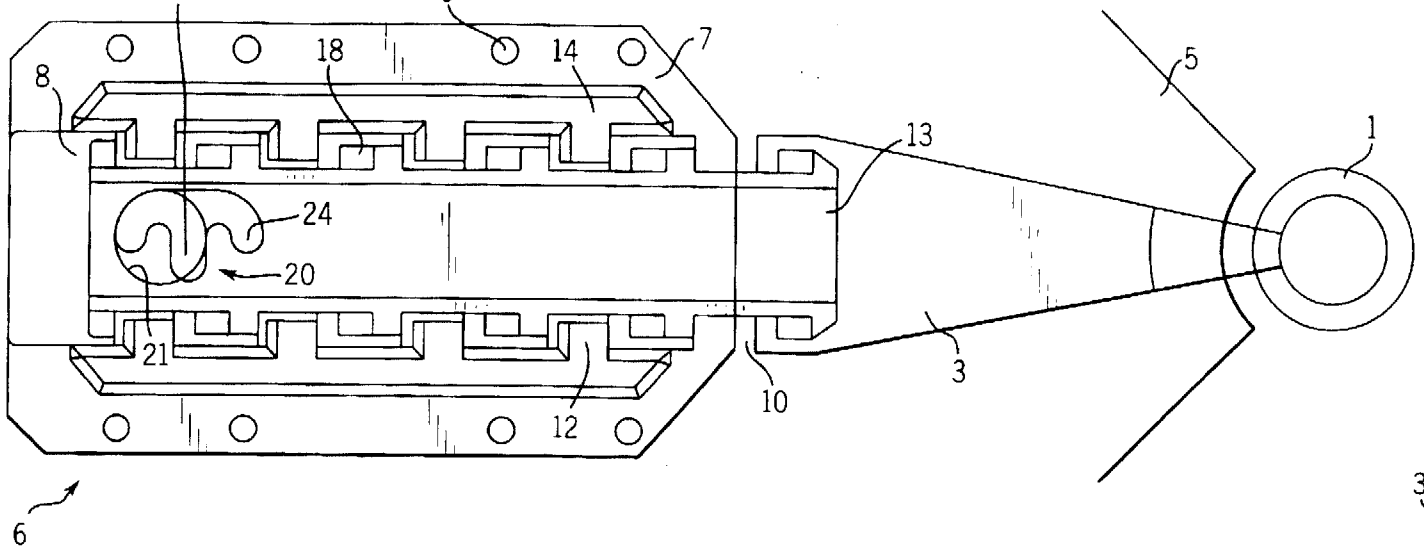
FIG. 2 is a diagrammatic plan view of the underside of the table top with a table leg strut and a rapid locking device with which the strut can be locked to the underside of the table top, the locking device being shown in an unlocked position.

In order to be able to rapidly and simply convert and reorganize the table system and correspondingly displace the table leg, the table leg strut 3 can be attached to an underside of the table top 4 in several predetermined positions and a rapid locking device 6 is provided, in the manner shown in FIG. 2, for locking the table leg strut 3 in the predetermined positions. The table leg strut 3 has a substantially rectangular, hollow cross-section and is preferably constructed as a sheet steel structure, as shown in FIG. 3.

Figure 4:
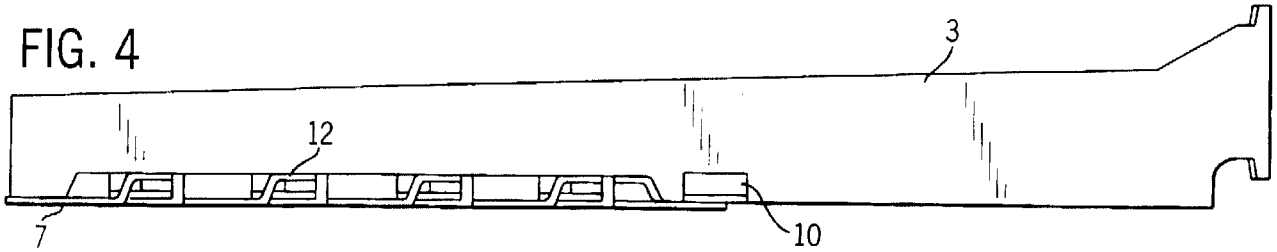
FIG. 4 is a side view of the table leg strut and rapid locking device of FIG. 2.

The rapid locking device 6 fundamentally has two locking parts 7 and 8 and is partly integrated into the table leg strut 3. As shown in FIG. 2, the locking part 7 is rigidly connected to the table top 5 by means of several screws 9, whereas the second locking part 8 is in one piece with the table leg strut 3 and forms an end portion thereof. As shown in FIGS. 2 and 4, along two edge areas facing the table top 5, regularly spaced recesses 10 are provided in the table leg strut 3 in a longitudinal direction thereof and said recesses extend from an underside of the strut 3 into the side walls 11 of said strut 3, as can be seen in FIG. 3.

The locking part 7, in the form of a sheet metal pressing, mounted on the table top 5 has several regularly spaced projections 12 complementary to the recesses 10 of the table leg strut 3 and which are arranged in such a way that the recesses 10 and projections 12 engage in one another if the table leg strut 3 is placed on the table top 5. The arrangement of the recesses and projections could obviously be reversed, i.e. the projections could be on the table leg strut 3 and the recesses on the locking part 7 and on the strut side opposite to the table top 5 and the corresponding area of the connecting piece there could be projections and complementary recesses such as e.g. alignment or fitting holes and pins. However, the construction shown in FIGS. 2 and 4 offers advantages with respect to the manufacture of the two parts and the arrangement of the locking mechanism, as will be explained hereinafter.

The number of recesses 10 is at least one greater than the number of projections 12, so that the projections and recesses form a raster along a straight line and the table leg strut can be attached to the table top 5 in several predetermined positions.

On superimposing the two locking parts 7 and 8, the projections 12 and recesses 10 engage in one another in such a way that the table leg strut 3 is substantially fixed in a plane parallel to the table top 5 and is held in the corresponding position.

Figure 5:
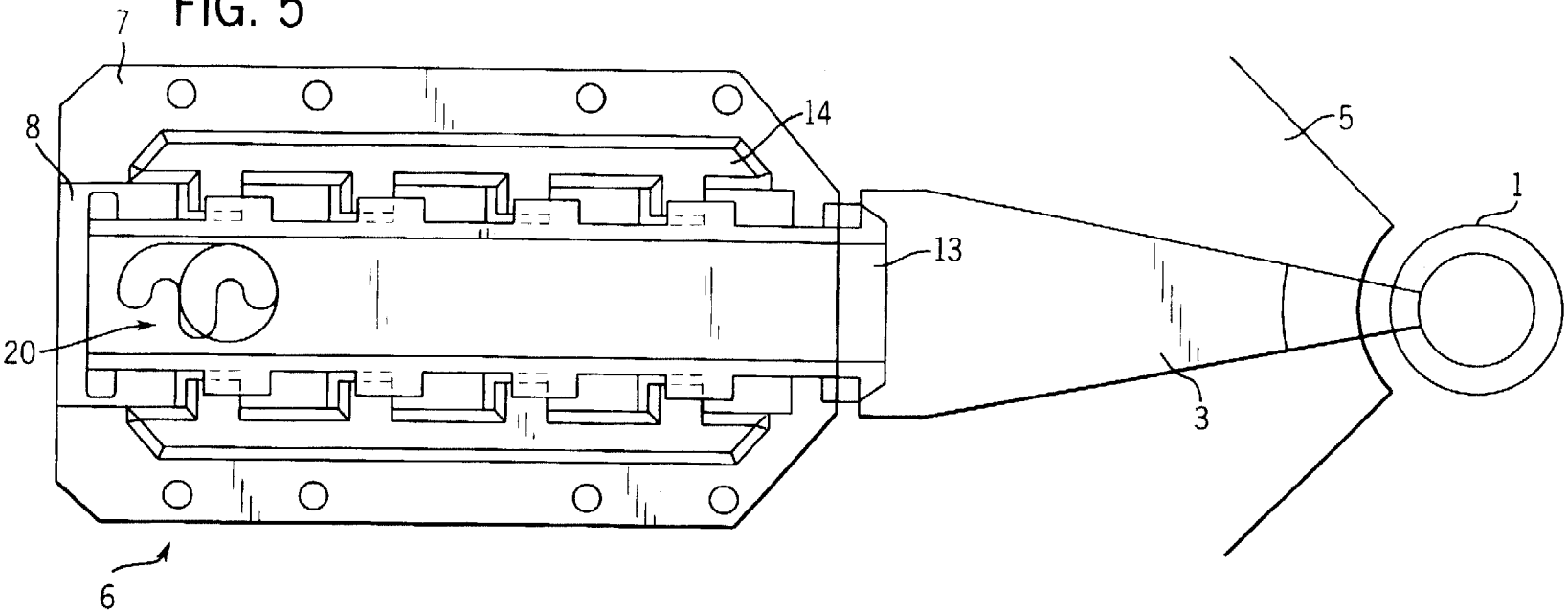
FIG. 5 is a diagrammatic plan view similar to FIG. 2 of the table leg strut and rapid locking device according to the embodiment of the preceding drawings, the locking device being shown in a locked position.
Figure 6:
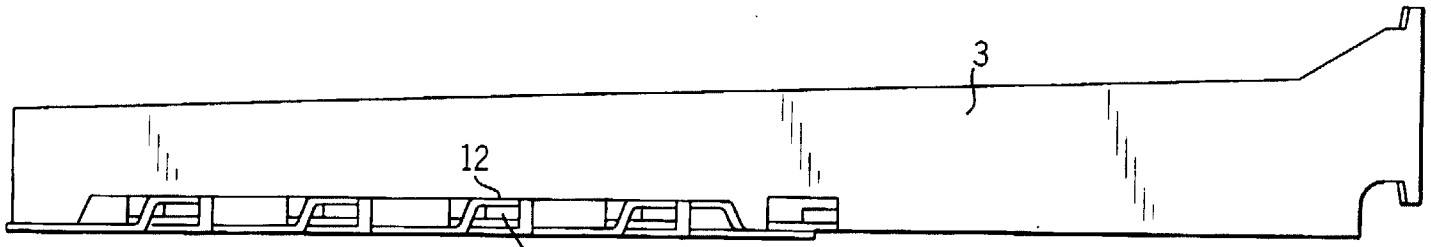
FIG. 6 is a side view similar to FIG. 4 of the table leg strut and rapid locking device in the locked state.

In order to connect the table leg strut 3 in a rigid and rocking-free manner to the table top 5, the rapid locking device 6 has a clamping mechanism, which presses the table leg strut 3 against the table top 5 or the two locking parts 7 and 8 against one another. The clamping machanism comprises an engagement part 13 displaceable in translatory manner in a plane parallel to the table top 5 and an engagement part 14 in one piece with the locking part 7 and which are in are in locking engagement with one another if the egagement part 13 is moved into the corresponding position. In the position of the engagement part 13 shown in FIG. 2, the two engagement parts 13 and 14 are disengaged, whereas the two parts are locked together if the engagement part 13 is moved in the viewing direction of FIG. 2 to the left into its locking position, as shown in FIGS. 5 and 6.

The movable engagement part 13 is an elongated, substantially flat, sheet metal part located within the table leg strut 3 and guided in the latter in longitudinally displaceable manner. As the guide the interior of the table leg strut 3 firstly contains a guide plate 15 in such a way that between the latter and an underside of the table leg strut 3, which is opposite to the table top 5, the engagement part 13 is guided. In addition, as shown in FIG. 3, in the underside of the table leg strut 3 there are two longitudinally directed creases 16 and in the engagement part 13 complementary cambers 17, which guide the engagement part 13 in a direction at right angles to the longitudinal direction and to the sliding direction of the engagement part 13. However, it is also possible to have in the plate 15 other arrangements of projections and guide grooves.

As shown in FIG. 2, the movable engagement part 13 has on two outsides comb-like engagement noses 18, which are in one piece with the body of the engagement part 13. Complementary engagement noses are provided on the engagement part 14 rigidly associated with the table top 5, said noses being formed by the projections 12. Thus, the projections 12 serve on the one hand to position the table leg strut 3 in the plane parallel to the table top 5 and on the other said projections 12 form engagement noses lockable with the engagement noses 18 of the displaceable engagement part 13. The engagement noses 18 and projections 12 engage in one another in comb-like manner in the unlocked position, shown in FIGS. 2 and 4, so that the table leg 3 can be vertically raised from the table top and also placed on the same whereas, with respect to a direction perpendicular to the table top, the engagement noses 18 and projections 12 can be slid over one another (in the position shown in FIGS.

5 and 6), so that the table leg strut 3 is fixed and can no longer be removed in vertical manner from the table top, because the engagement noses 18 engage below the projections 12.

As can be gathered from FIGS. 2 and 5, the two engagement parts 13 and 14 in each case have a plurality of engagement noses, so that the table leg strut 3 can be braced on a plurality of clamping points spaced in a plane parallel to the table top 5 against the latter, so that tilting moments acting on the strut can be absorbed with favorable leverage conditions and the connection between the table leg strut and the table top has a high rigidity.

In order to be able to move the engagement part 13 guided in the interior of the table leg strut 3 between its locking and released positions, a manually operable sliding mechanism 20 is provided. A rotary control part (not shown) with an eccentric engagement peg engages in a guide groove 22 formed in the engagement part 13 and a rotation of the control part about an axis substantially perpendicular to the table top 5 by means of the guide groove 22 in crank-like manner brings about a sliding of the part 13, the rotary control part extending through an opening 21 in the table leg strut 3 and optionally the guide plate 15. As shown in FIG. 2, the guide groove 22 has a fork shape, the two outer branches 24 forming a stop in which engages a stop peg arranged diametrically to the engagement peg with respect to the rotation axis of the control part and limits the turning of the control part in a position corresponding to the locking or released position of the engagement part.

The rotary control part can be connected to a hand lever (not shown), which can be operated in a simple manner.

Figure 7:
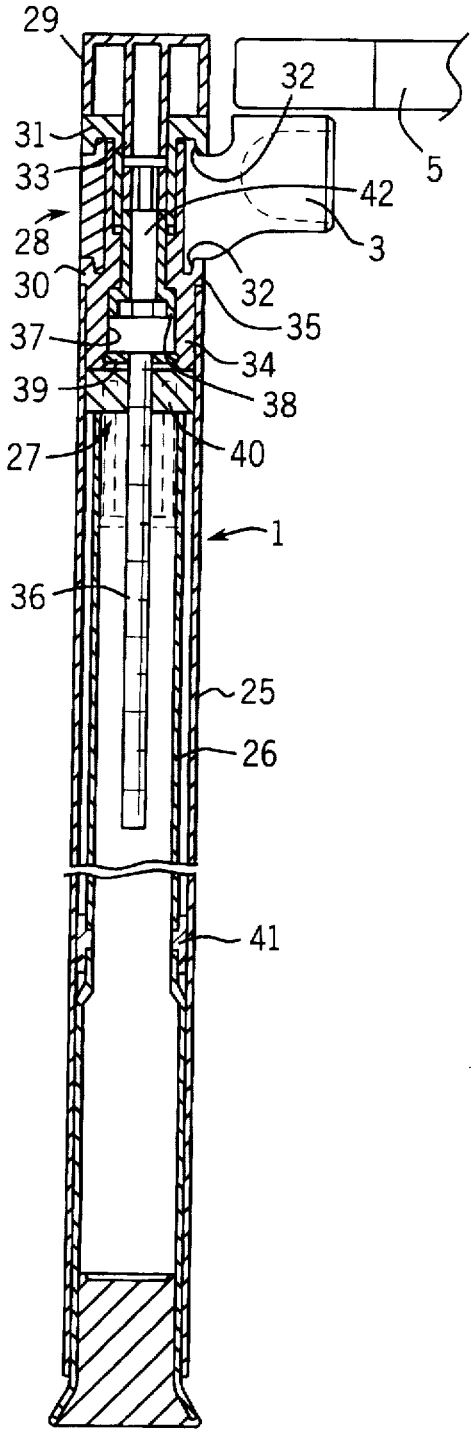
FIG. 7 shows a table leg with two telescoped tubes and a head in a sectional representation according to the embodiment of the preceding drawings, a table leg strut fixed to the head and a table top being shown, the table leg being represented in a position projecting over the table top.
Figure 8:
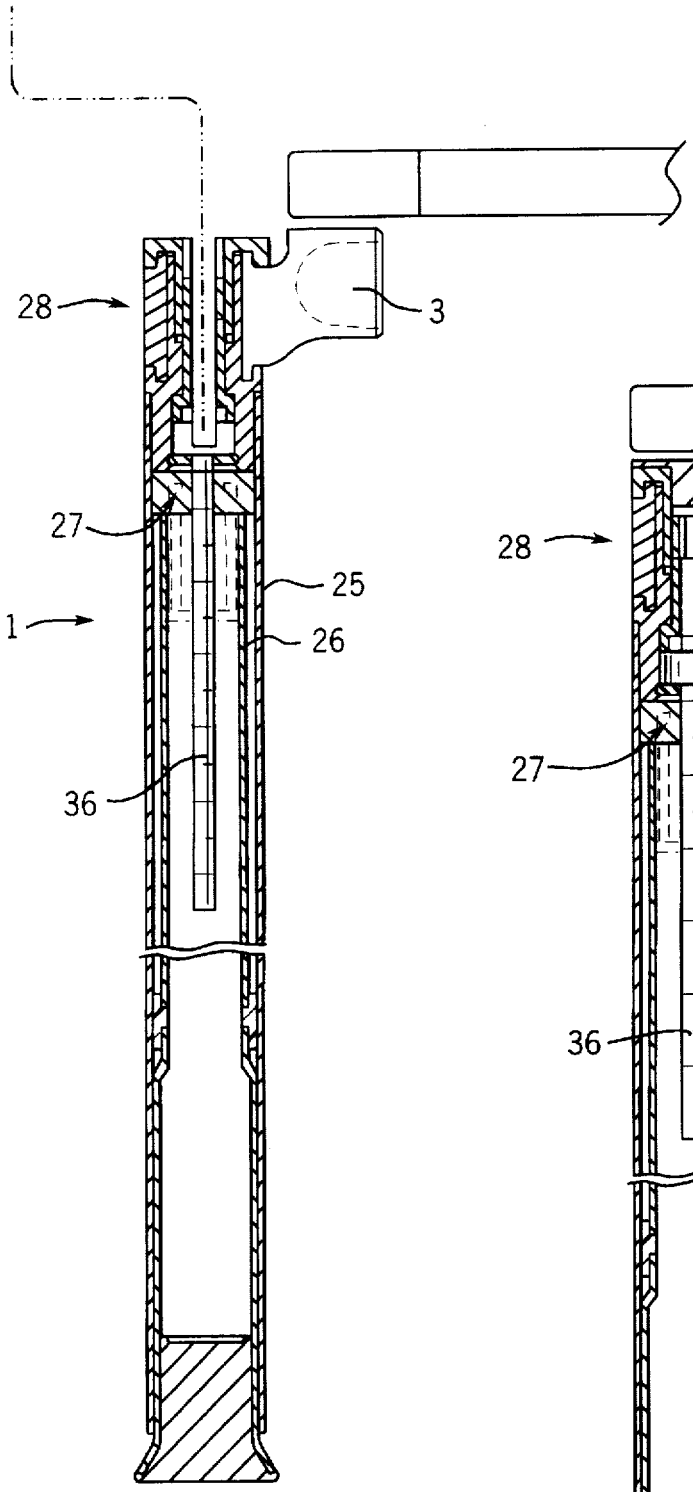
FIG. 8 is a sectional representation of the table leg similar to FIG. 7, in which for longitudinal adjustment purposes a cap of the head is removed and a diagrammatically represented tool is inserted in the head.
Figure 9:
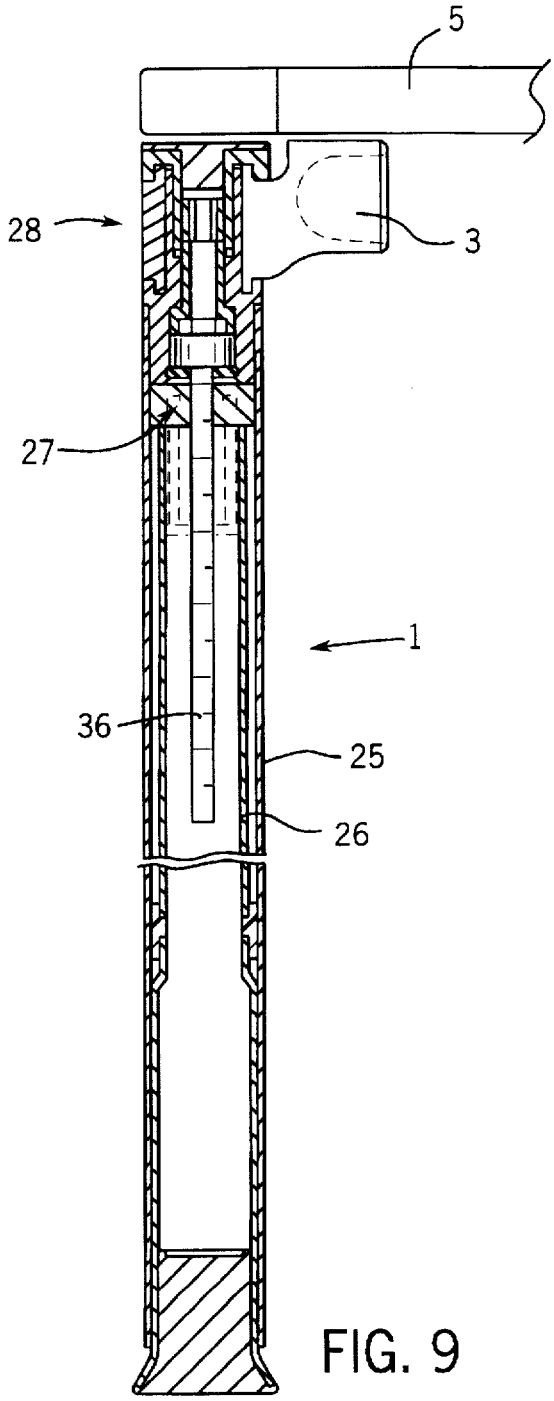
FIG. 9 is a sectional representation of a table leg similar to FIGS. 7 and 8, the leg being in a position below the table top.

In order to be able to adapt the table system to different requirements, as shown in FIGS. 7 to 9 the table leg 1 is longitudinally adjustable. The table leg 1 has two telescopable tubes 25 and 26, between which is located an adjusting mechanism 27, which is positioned within the table leg 1.

As shown in FIG. 7, on the upper end of the table leg 1 is placed a head 28, to which is fixed a table leg strut 3. A cap 29 is mounted on the upper end of the head 28. In order to achieve a rigid and stiff connection between the head 28 and the table leg strut, the head 28 has a clamping device. The head has two rotationally symmetrical clamping parts 30 and 31, which in each case have in facing manner an undercut 32, whose outer flank, as shown in FIG. 7, is inclined outwards in funnel-shaped manner with an angle of approximately 10° to 20° relative to the longitudinal axis of the table leg. Thus, a correspondingly shaped connecting piece of the table leg strut 3 can be clamped between the two undercuts 32 of the two clamping parts 30 and 31, in which said parts are clamped against one another. This makes it possible for the direct screwing together of the two clamping parts 30 and 31, or the cap 29 can be screwed in the clamping part 30, so that the interposed clamping part 31 is clamped against the clamping part 30. The cap 29 has a cylindrical lug 33, which is inserted in an axial bore in the clamping part 31 or can optionally be screwed into a thread in the facing clamping part 30. The two clamping parts 30 and 31, as well as the connecting piece of the table leg strut 3 are preferably made from steel, so as to ensure an adequate rigidity.

As can be seen in FIG. 7, at its lower end the head 28 has an insertion lug 34, which is bounded by a collar 35 and which can be inserted or pressed up to the collar 35 into the outer of the two tubes 25.

The adjusting mechanism 27 for the longitudinal adjustment of the table leg 1, as shown in FIG. 7, has a screw connection coupling together the two tubes 25 and 26. The head of a setscrew 36 is received in a cylindrical recess 37 of the head 28 and is upwardly supported against the head 28 by means of a support sleeve 38. The setscrew 36 rotates with respect to the head 28, but is axially fixed by the support sleeve 38 and also by an axial ring 39.

To the inner tube 26 the setscrew 36 is connected by means of an end piece 40 mounted on the upper end of the inner tube 26. The end piece 40 is optionally in screw engagement by means of a threaded bushing inserted in the end piece 40 with the setscrew 36 and also serves as a guide bushing for the upper end of the inner tube 26. As shown in FIG. 7, an upper portion of the inner tube 26 is cross-sectionally tapered with respect to the lower portion of said tube, whose length roughly corresponds to the maximum adjustment path, so that between the two tubes 25 and 26 can be inserted as a guide a plastic sliding bushing 41, which is fixed to the inner tube 26. The two tubes 25 and 26 can be guided in spaced manner, so that neither can an outside of the inner tube 26 be scratched, nor can the two tubes rattle or wobble.

In its head the setscrew 36 has a hexagonal internal recess, whilst in the head 28 is formed a cylindrical through recess 42, which issues onto the head of the setscrew 36, so that the hexagonal internal recess of the setscrew 36 is accessible from above through the head 28, as shown in FIG. 8. To operate the adjusting mechanism 27, it is possible to introduce through the recess 42 a screwing tool, diagrammatically shown in FIG. 8, into the hexagonal internal recess of the setscrew in order to be able to turn the latter. The through recess 42 extends in axially parallel manner to the table leg 1 through the two clamping parts 31 and 30 and has, as shown in FIGS. 7 and 9, in the upper clamping part 31 a larger diameter portion 43, in which is formed a hexagonal engagement portion 44, so as to be able to screw the upper clamping part 31 with a corresponding tool. The engagement portion 44 has a larger diameter than that of the recess 42 in the vicinity of the lower clamping part 41, so that on adjusting the setscrew 31 fixed with a corresponding tool, there is no engagement with the engagement portion 44 on the upper clamping part 31.

Figure 10:
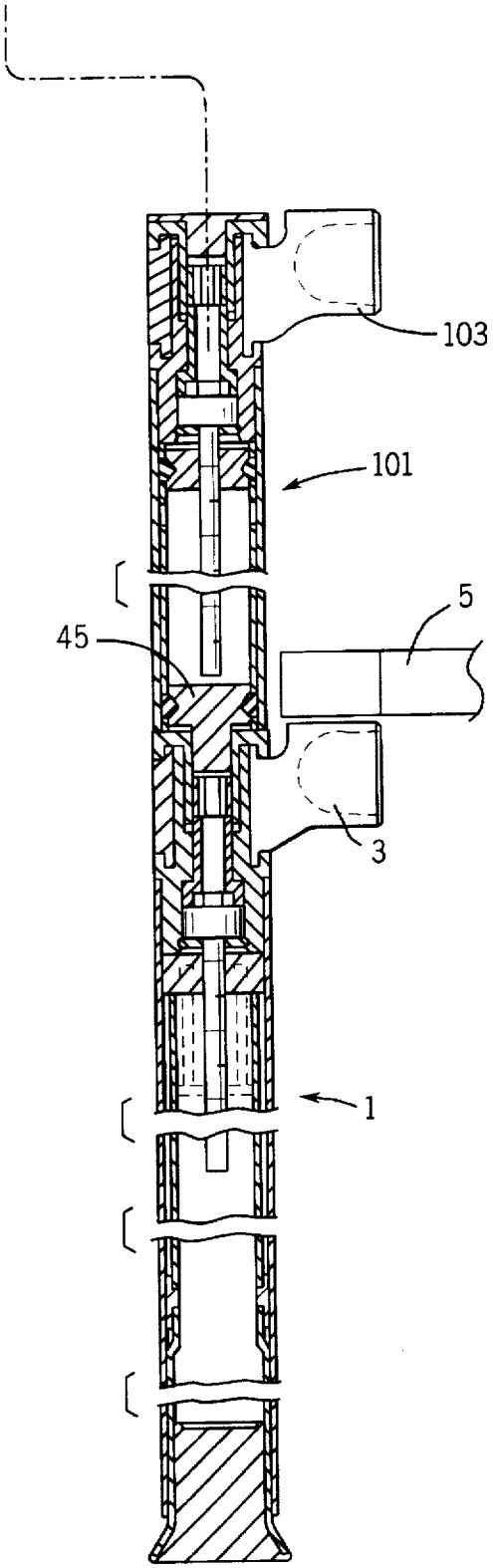
FIG. 10 is a sectional representation of a table leg according to another embodiment of the invention, in which on said leg is mounted as an extension a further table leg for receiving a further working board in a further plane.
Figure 11:
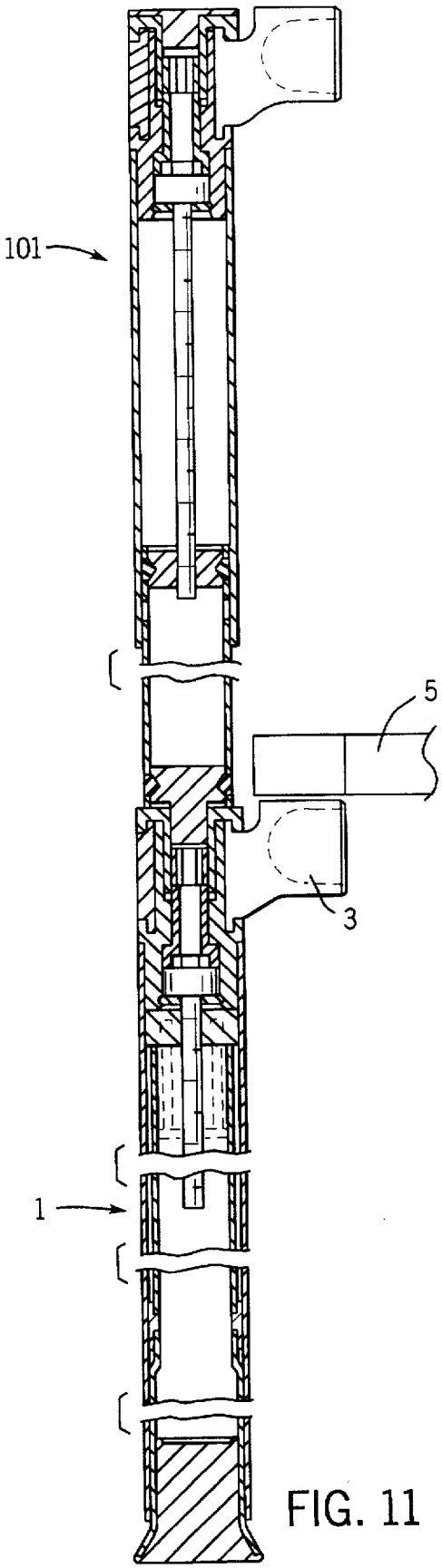
FIG. 11 is a sectional representation of the superimposed table legs according to FIG. 10, the leg serving as the extension being represented in an extended position.

FIGS. 10 and 11 show another embodiment of the table system, in which on a table leg 1 can be placed an extension 101, so as to be able to arrange a further table top over the table top 5 in a further plane. At its lower end the extension 101 has a connecting piece 45 with a cylindrical lug, which is insertable in similar manner to the cap 29 of the preceding embodiment in the recess 42 of the head 28 of the leg 1. The extension 101 substantially corresponds to the table leg 1, so that no further explanation would appear to be necessary. As shown in FIG. 11, the extension 101 is correspondingly lengthenable, so that it is also possible to adjust the level of the second table top, which is carried by the extension 101 and the corresponding strut 103.

The operation of the adjustable table system will now be explained in greater detail. The function of the rapid locking mechanism 6 can be gathered from FIGS. 2 to 6. In order to be able to mount a table leg 1 on one or more table tops, firstly the corresponding table leg struts 3, namely in the case of FIGS. 2 to 6 a strut 3, is mounted on the head 28 of the table leg 1. If several table leg struts 3 are to be connected to a table leg 1, the fixing of the struts to the head 28 can initially have a loose setting, so as to permit a mutual angular turning of said struts 3.

The preassembled table leg strut 3 with the table leg fixed thereto is mounted from below in a substantially vertical manner on the table top 5, the locking parts 7 and 8 being placed on one another in a desired position corresponding to the rastering predetermined by the projections 12 and the recesses 10. Preferably, if the table leg 1 is only to be connected to one table top 5, the table leg strut 3 is placed on the top 5 in the left position of FIG. 2, so that the leg 1 comes to rest below the top 5, whereas preferably in the case that the table leg 1 is to be coupled with several tops, the strut 3 is placed in the right position corresponding to FIG. 2, so that the leg 1 projects laterally over the table top 5.

In order to be able to superimpose the two locking parts 7 and 8, the engagement part 13 is in its unlocked position. When the two locking parts 7 and 8 are placed on one another, the shifting mechanism 20 is operated manually in order to slide the engagement part 13 into its locking position and lock and secure the table leg strut 3 on the table top 5. In order to be able to displace the table leg strut 3, the locking mechanism 6 is released, the table leg strut 3 is removed vertically from the table top 5, brought into a new position corresponding to means 12 and 10 and by operating the rapid locking device 6 is again locked and secured.

The operation of the longitudinal adjustment of the table leg 1 can be gathered from FIGS. 7 to 9. For the case that the table leg is located in a position projecting over the table top 5, as shown in FIGS. 7 and 8, the adjusting mechanism 27 can be operated directly from above through the head 28. For this purpose the cap 29 must firstly be removed and through the recess 42 a corresponding tool, indicated in FIG. 8, is engaged with the setscrew 36. By turning the setscrew 36 the end piece 40 and consequently the inner tube 26 are adjusted relative to the outer tube 25. As can also be gathered from FIGS. 7 and 8, the direction of force lines in the case of a vertical loading of the table leg is through the inner tube 26, via the setscrew 36 and the support sleeve 38 directly to the head 28, so that the outer tube 25 can be given a lightweight construction.

Apart from the direct adjustment from above through the head 28, the length of the table leg 1 can also be adjusted by turning the two tubes 25 and 26 relative to one another. This is particularly advantageous if the table leg 1 is positioned below the table top 5, as shown in FIG. 9, because then the adjusting mechanism 27 is possibly not accessible from above.

The present invention creates a variable table system, which is characterized by a very easy and rapid adjustability and leads to a rigid connection between the table leg and table top. Moreover, the possibility of mounting the table leg strut in different predetermined positions and a rapid locking in these positions, leads to a particularly simple connection of several table tops with one table leg.

It is also possible to connect two juxtaposed table tops by means of a connecting piece, which has two corresponding rapid locking devices, possibly even without a table leg. Several tables or table tops can be easily and rapidly interconnected in network-like manner, reorganized and adapted to different needs as a result of the present table system.

We claim:

1. Adjustable table system comprising:

a table top having an underside;

a table leg extending downward from an upper end; and at least one table leg strut connected with said table leg;

a rapid attaching device for attachment of the table leg strut to the table top;

wherein said rapid attaching device is provided with a first part fixed to said table top and a second part extending from said table leg strut; and wherein said first part and second part of said rapid attaching device form a mating connection in any one of a plurality of attachment positions of said table leg strut, such that an attachment position of said upper end of the table leg can be adjusted in a direction along the underside of the table top corresponding to any one of said plurality of said attachment positions of said table leg strut.

2. The adjustable table system according to claim 1, wherein the rapid attaching device has a locking mechanism for securing the table leg strut to the table top as the first and second parts are attached in one of said plurality of attachment positions.

3. The adjustable table system according to claim 2, wherein the rapid attaching mechanism has several points of mating connection, which are spaced in one plane.

4. The adjustable table system according to claim 1, wherein the first part is rigidly connected to the table top and the second part is rigidly connected to the table leg strut.

5. Adjustable table system for receiving at least one table top, said system having a table leg and at least one table leg strut associated therewith, said table leg strut being adjustable relative to the table top, wherein the table leg strut is provided to be attached to the said table top from an underside thereof in several predetermined positions, the table system comprising a rapid locking device for locking the table leg strut in one of said predetermined positions;

wherein the rapid locking device has two locking parts, one of the locking parts being rigidly connected to the table top and the other locking part being rigidly connected to the table leg strut; and wherein the two locking parts are adapted to be placed on one another in different positions along a straight line and to be locked to one another, the two locking parts in the locked state being braced against one another and having regularly spaced recesses and complementary projections, which are provided for engagement with one another in different positions.

6. Table system according to claim 5, wherein means are provided for connecting the table leg to the table top in a position below the table top and, for supporting several table tops, by means of several table leg struts in a position projecting laterally over the table top.

7. Table system according to claim 5, wherein the rapid locking device has a fixed engagement part and an engagement part displaceable in translatory manner, which can be brought into, locking engagement with one another, the displaceable engagement part being movable between a locking position and a released position.

8. Table system according to claim 7, wherein a shifting mechanism is provided for shifting the displaceable engagement part between the locking and released positions thereof.

9. Table system according to claim 8, wherein the shifting mechanism comprises a rotary control part in engagement with a guide, formed in the displaceable engagement part, so that a turning of the control part corresponds to a sliding of the engagement part.

10. Table system according to claim 8, wherein the displaceable engagement part and the shifting mechanism are associated with the table leg strut.

11. Table system according to claim 5, wherein the table leg strut comprises a hollow section, the rapid locking device associated with the table leg strut in part being located in the interior of said hollow section.

12. Adjustable table system comprising:

at least one table top;

at least one table leg;

at least one table leg strut connected with said table leg by a head rigidly fixed to one end of said table leg;

means for connecting said table leg strut to said table top in several alternative positions;

an adjusting mechanism provided within said table leg, for adjusting the length of said table leg;

wherein said table leg comprises:

an outer tube and an inner tube extending along a common axis, said outer tube having a hollow central portion, and said inner tube telescoping in said hollow central portion;

a guide provided between said outer tube and inner tube, for guiding said outer tube relatively to said inner tube when telescoping;

said adjusting mechanism comprising:

a setscrew extending along said common axis of the outer tube and the inner tube, said setscrew being separate from and rotatable with respect to said inner tube and said outer tube;

an engagement piece in screw engagement with said setscrew, said engagement piece being fixedly mounted to one of said inner tube and said outer tube; and wherein said head is provided with means for rotatably, axially and fixedly supporting said setscrew; and wherein said head forms an access opening to said setscrew, for accessing said setscrew from outside said head;

thereby providing longitudinal adjustment of the table leg in two operation modes comprising i) direct operation of said setscrew from the top of said table leg and ii) rotating the outer tube in relation to the inner tube.

13. Table system according to claim 12, wherein the head has a clamping device for clamping at least one table leg strut, the clamping device including two mutually adjustable and screwable clamping parts between which can be clamped at least one table leg strut.

14. Table system according to claim 13, wherein the adjusting mechanism for the longitudinal adjustment of the table leg is mounted on the clamping device, the adjusting mechanism and the clamping device being operable along coaxial axes.

15. Table system according to claim 12, wherein the table leg is adapted to be connected with an extension for receiving a further table top in a further plane.

* * * * *